US007625202B2

(12) United States Patent
Amoros et al.

(10) Patent No.: US 7,625,202 B2
(45) Date of Patent: Dec. 1, 2009

(54) CHILD-RESISTANT LIGHTER HAVING A FLEXING LATCH

(75) Inventors: Enrique Nollas Amoros, Rues (ES); Michel Doucet, Bains sur Oust (FR)

(73) Assignee: BIC Corporation, Shelton, CT (US)

( * ) Notice: Subject to any disclaimer, the term of this patent is extended or adjusted under 35 U.S.C. 154(b) by 333 days.

(21) Appl. No.: 09/795,964

(22) Filed: Feb. 28, 2001

(65) Prior Publication Data

US 2002/0119409 A1 Aug. 29, 2002

(51) Int. Cl.
*F23Q 2/16* (2006.01)
*F23Q 2/34* (2006.01)

(52) U.S. Cl. ..... 431/153; 431/255

(58) Field of Classification Search ..... 431/153, 431/255, 344, 277
See application file for complete search history.

(56) References Cited

U.S. PATENT DOCUMENTS 3,208,243 A * 9/1965 Zellweger et al. ..... 431/131
5,165,886 A * 11/1992 Frigiere ..... 431/254
5,184,948 A * 2/1993 Iwahori ..... 431/153
5,228,849 A * 7/1993 Frigiere ..... 431/255
5,240,408 A 8/1993 Uematsu et al.
5,324,193 A * 6/1994 Pan ..... 431/153
5,437,549 A * 8/1995 Saito ..... 431/153
5,458,482 A * 10/1995 Saito et al. ..... 431/153
5,472,338 A 12/1995 Ansquer et al.
5,558,514 A * 9/1996 Ansquer ..... 431/153
5,642,993 A * 7/1997 McDonough et al. ..... 431/153
5,645,414 A * 7/1997 Wang ..... 431/153
5,788,474 A * 8/1998 Chung et al. ..... 431/153
5,829,963 A * 11/1998 Ichikawa ..... 431/153
5,836,755 A * 11/1998 Sheng et al. ..... 431/153
5,885,069 A * 3/1999 Rogelet ..... 431/153
5,971,751 A * 10/1999 Lee ..... 431/153
6,022,211 A 2/2000 Wang
6,039,561 A * 3/2000 Lei ..... 431/153
6,102,689 A * 8/2000 Man ..... 431/153
6,135,761 A * 10/2000 Chen ..... 347/48
6,386,860 B1 * 5/2002 Adams et al. ..... 431/153

FOREIGN PATENT DOCUMENTS

EP 000514287 A1 * 12/1992

* cited by examiner

*Primary Examiner*—Carl D Price
(74) *Attorney, Agent, or Firm*—Jones Day

(57) ABSTRACT

The present invention relates to disposable cigarette lighters which have a latch member which is intended to resist inadvertent operation and to make undesirable operation by unintended operators more difficult. The lighter preferably includes a latch member which in its initial condition blocks movement of the actuator in order to resist operation of the lighter. The latch member is movable to a ready position so that the actuator may be depressed in order to produce a flame. It is preferred that the lighter contain additional or alternative forces on the latch member to improve the ability of the latch member to return to the blocking position over the life of the lighter and to improve the consistency of the latch member's movement and return. In some of the embodiments, this additional or alternative force is provided by a bending moment or flexing force preferably applied to the latch member through a flexing mechanism to flex the latch along at least a portion of its length. Alternatively or in addition to, a biasing member may assist in returning the latch member to the initial position over the life of the lighter and improve the consistency of the latch force.

20 Claims, 14 Drawing Sheets

CHILD-RESISTANT LIGHTER HAVING A FLEXING LATCH

BACKGROUND OF THE INVENTION

1. Technical Field

The present invention relates to disposable lighters and more particularly to such lighters which present increased difficulty of operation by unintended users.

2. Background Art

Disposable lighters are available in a variety of forms. One typically common element of disposable lighters is an actuator pad used to release fuel from a reservoir in the lighter. The actuator pad may be used in conjunction with a spark-producing mechanism so that the fuel is ignited soon after it is released. For example, lighters employing conventional spark wheels require a user to rotate a toothed spark wheel against a flint in order to generate a spark. The user then depresses the actuator pad to release and ignite the fuel.

Instead of using a spark wheel, some disposable lighters use piezoelectric mechanisms to generate a spark. In this type of ignition mechanism, a piezoelectric element, such as crystal, is struck by a plexor in order to produce an electric spark where the fuel is released from the lighter. An example of such a piezoelectric ignition mechanism is disclosed in U.S. Pat. No. 5,262,697, entitled "Piezoelectric Mechanism for Gas Lighters." Typically, actuator pads for disposable lighters using piezoelectric elements are configured and sized to both release fuel and generate a spark so that a user need only push the actuator pad to operate the lighter.

Lighters have been developed to resist undesired operation by unintended users. One typical response is to provide a latch which inhibits inadvertent activation of the actuator pad and makes operation of the lighter more difficult for unintended users. Examples of such latches are illustrated in U.S. Pat. Nos. 6,077,070; 6,022,211; 5,885,069 and 5,228,849. The latches in U.S. Pat. Nos. 6,022,211; 5,885,069 and 5,228,849 are made of a plastic material formed integrally with the actuator pad so that it interferes with the lighter housing to block the actuator pad from being depressed but also permits the latch to be moved inwards into a non-interfering position which allows the actuator pad to be depressed. FIGS. 1*a*-1*c* illustrate such a latch in various stages of operation from an initial blocking position (FIG. 1*a*), a ready or non-blocking position (FIG. 1*b*), and an actuated position (FIG. 1*c*).

As shown in FIG. 1*a*, when the lighter is not in use and the latch is in its initial position, a stop on the outer portion of the latch is positioned in an interfering or blocking relationship with the housing of the lighter to reduce the chance of inadvertent operation of the lighter. In this regard, the latch may be assembled in the lighter in a manner such that it is preloaded and biased into the blocked position. Operation of the lighter thus requires a user to first move the stop on the latch out of interference with the housing by pressing the latch member inwardly. (See FIG. 1*b*). The latch member bends at its connection to the actuator pad until the latch member contacts a catch mechanism that holds the latch member in order to keep the stop from interfering with the housing. Once the latch member is held by the catch mechanism, the user no longer needs to press the latch to keep it from interfering with the housing. Thus, the user is free to operate the lighter by activating the actuator pad. (See FIG. 1*c*). The latch member is released from the catch mechanism during motion of the actuator pad so that when the actuator pad returns to its initial position, the latch member returns to its initial blocking position. Over time, the ability of the latch member to return to its initial blocking position may be diminished as shown in FIG. 1*d*. It is desirable for the latch member to return to its blocking position repeatedly over the life of the lighter and with consistent latch force.

SUMMARY OF THE INVENTION

According to the present invention, a lighter having improved resistance to inadvertent or unintended use is disclosed. One aspect of the lighter is directed to providing a force to a latch member so that the latch member flexes or bends to improve its ability to return to an interfering relationship with the lighter housing after completed use of the lighter. A component, assembly, or mechanism may apply a force to the latch member so that the latch member will return to its blocking position more readily or so that the force to unlock the latch member will not reduce to the same extent over time and usage of the lighter.

In one embodiment, the lighter is configured to apply a flexing or bending force to a latch member which causes the latch to flex or bend to improve its ability to return to the initial or at rest position where the latch member blocks movement of an actuator or so that the force to unlock the latch member will not substantially diminish with time. This flexing or bending force may be applied by the housing of the lighter or other components of the lighter near the latch member, such as the ignition mechanism, a cammed surface, a catch mechanism, or the like, which are configured and adapted to cause the latch member to flex or bend. In one embodiment, this flexing or bending force is applied as the latch member is held in the ready position. Alternatively or in addition to, the flexing or bending force is applied as the latch member returns from an actuated position back to its initial position. In another embodiment, a biasing force, such as by a spring, is applied to the latch to move the latch into its initial interfering position upon completed use of the lighter.

The lighter, according to one embodiment, comprises a housing having a fuel reservoir, an actuator for selectively releasing fuel from the fuel reservoir, an ignition mechanism for igniting the fuel, an optional catch mechanism, an optional release member, and a latch member. The actuator is preferably mounted for movement with respect to the lighter housing and is movable from a first position to an actuation position. The actuator may comprise a valve controller and actuator button. The valve controller may undergo pivotal motion to operate the valve. In one embodiment, the actuator is movable along the longitudinal axis of the lighter. The ignition mechanism preferably is coupled to the actuator so that operation of the actuator operates the ignition mechanism.

The latch member is movable from an initial blocking position, in which the stop on the latch member interferes with the housing in order to make substantial movement of the actuator more difficult, to a ready position in which the latch member and stop are held by a catch mechanism so that they do not interfere with the housing. The latch member may be integrally coupled to the actuator. In one embodiment, the latch member is formed integrally with the actuator.

In one embodiment, the catch mechanism is formed from a skirt coupled to the actuator which extends in the direction of the actuation axis of the actuator. In this embodiment, the skirt or catch mechanism, latch member, and actuator move along the actuation axis together when the actuator is activated by a user. The latch member is held in its ready position by moving the latch through an opening in the skirt. Either the latch member or the opening in the skirt, or both, may be configured and adapted so that the latch member is held in a ready position after it has moved through the opening. The lighter further includes a release mechanism so that as the actuator is depressed, the latch member is released from the catch mechanism so that it is no longer held in the ready position. In a preferred embodiment, the release mechanism comprises a cam which releases the latch member from the catch mechanism.

In one embodiment, the lighter is further configured and adapted so that a portion of the latch member is imparted with a force which flexes or bends the latch member to assist in returning the latch to a position where it will block actuation of the lighter. Preferably, a flexure or bending moment is imparted to the latch member to assist in returning the latch to its initial blocking position. The flexing of or the bending moment imparted into the latch member assists in returning the latch member to the blocking position over the life of the lighter.

Many mechanisms are available to impart such a flex or bending movement into the latch member to bias or assist in biasing the latch member into the blocked position after operation of the lighter. For example, the latch member may be sized and configured to interact with the housing or components of the lighter in a manner to flex the latch in order to cause the latch to return to a ready position. For example, a force may be imparted to the lower portion of the latch member by the ignition mechanism, a cam surface or other lighter component to push the latch against the housing, the housing imparting a counterbalancing or counteracting force which flexes or bends the latch member. A protrusion or stop member may be formed on the latch member which acts as a fulcrum which abuts against the housing and applies a counterbalancing force which bends the latch. When the actuator is returned (moves upwardly) and the protrusion or stop member no longer acts as a fulcrum, the force applied at the bottom of the latch member returns the latch member to the blocked position. Alternatively or additionally, the release mechanism, and in particular the cam, can be configured with the latch member to impart a bending moment into the latch member or flex the latch member to return to the blocked position. The catch mechanism also may be configured and adapted to impart a bending moment or flex the latch to return the latch member to the blocked position. In another embodiment, a spring may provide the force to assist in returning the latch to its initial blocking position.

BRIEF DESCRIPTION OF THE DRAWINGS

To facilitate an understanding of the characteristics, structure and operation of the invention, the following drawings having preferred features have been provided wherein.

DESCRIPTION OF THE PREFERRED EMBODIMENTS

Figure 1B:
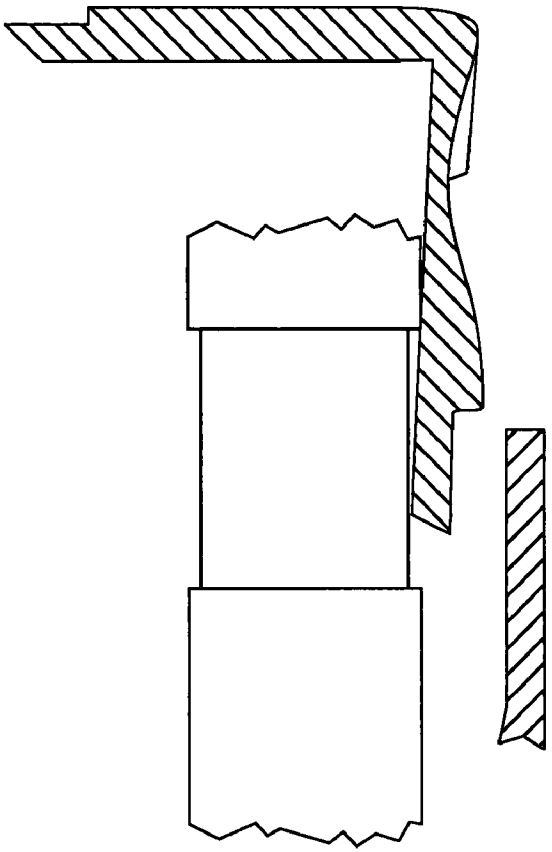
Fig. 1b (Prior Art)
FIG. 1*b* is an enlarged partial cross-sectional view of a conventional prior art lighter having a latch coupled to an actuator pad wherein the latch is in a ready position.
Figure 1A:
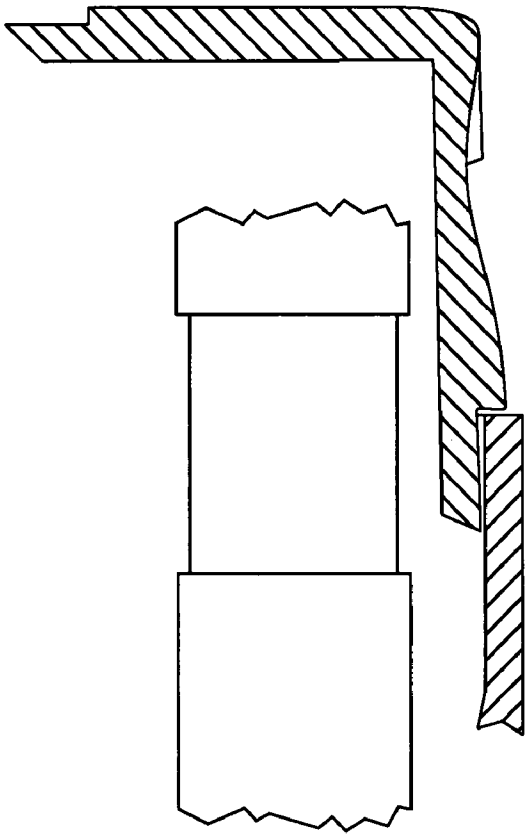
Fig. 1a (Prior Art)
FIG. 1*a* is an enlarged partial cross-sectional view of a conventional prior art lighter having a latch coupled to an actuator pad wherein the latch is in an initial blocking position.
Figure 1D:
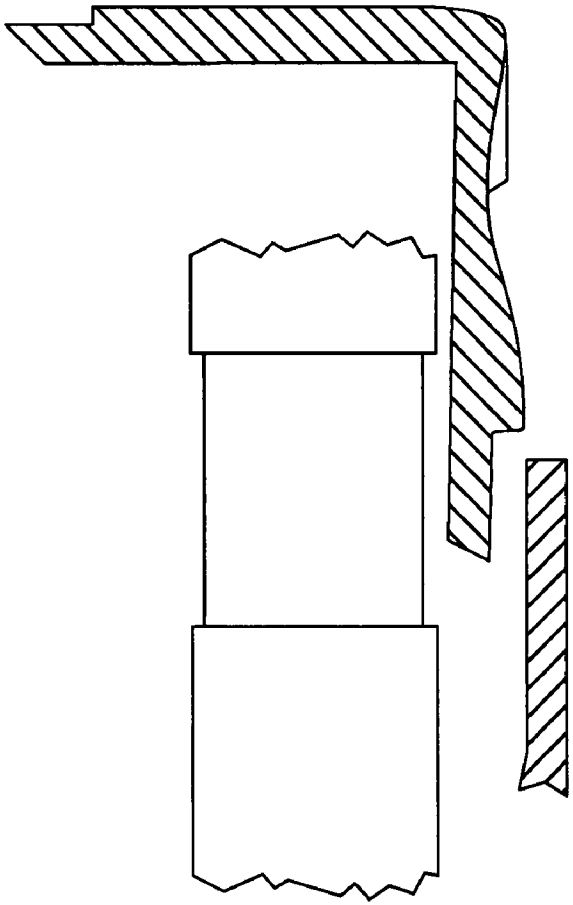
Fig. 1d (Prior Art)
FIG. 1*d* is an enlarged partial cross-sectional view of a conventional prior art lighter having a latch coupled to an actuator pad wherein the connection has been weakened from the initial state.
Figure 1C:
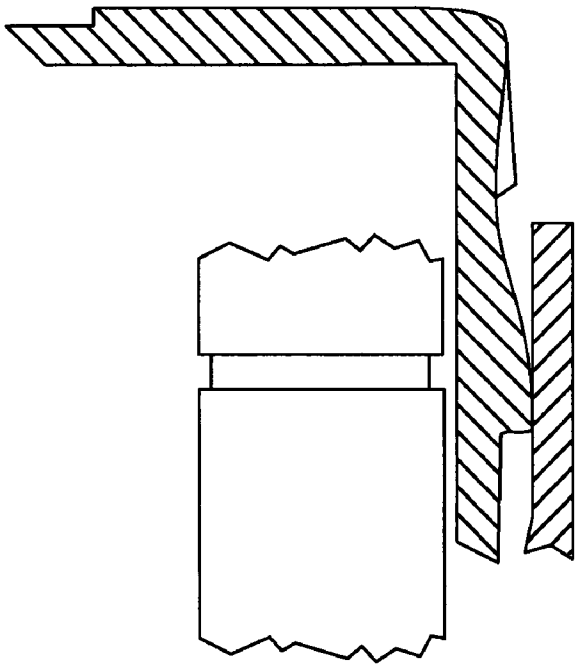
Fig. 1c (Prior Art)
FIG. 1*c* is an enlarged partial cross-sectional view of a conventional prior art lighter having a latch coupled to an actuator pad wherein the actuator pad has been activated to ignite the lighter.
Figure 2:
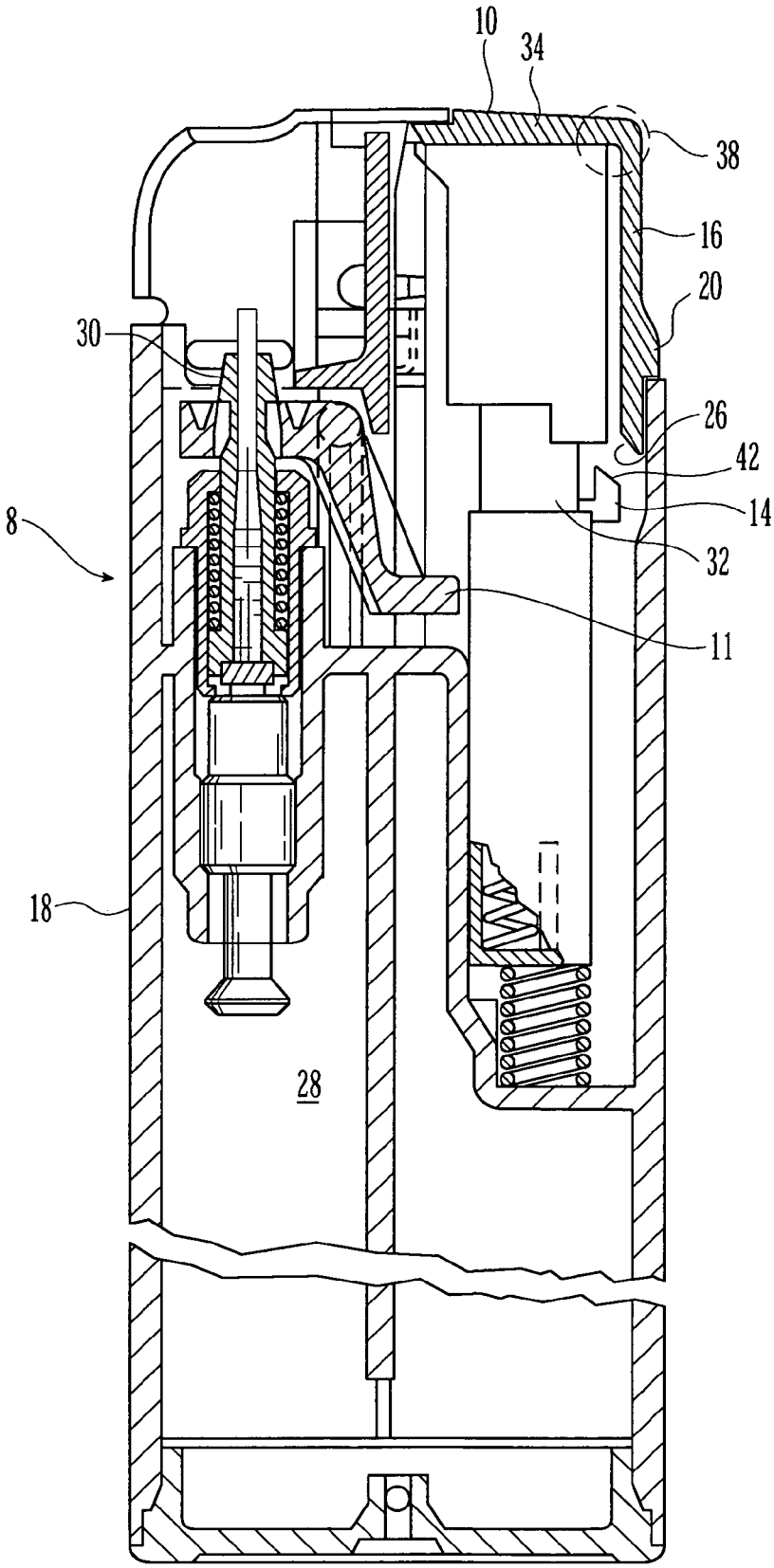
FIG. 2 is a cross-sectional view of a lighter in accordance with one embodiment of the present invention with portions removed for purposes of clarity.
Figure 3:
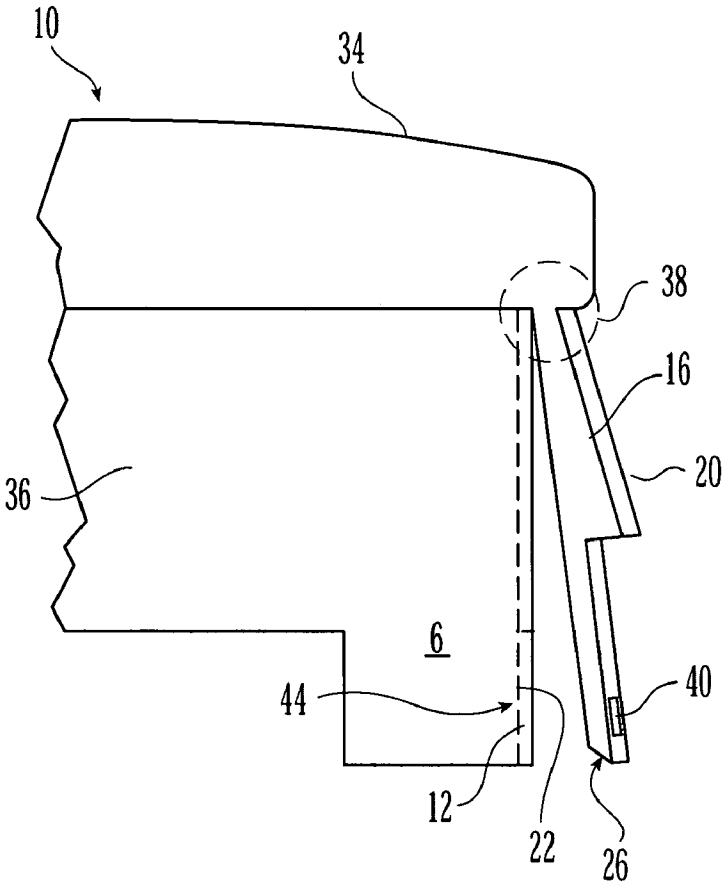
FIG. 3 is an enlarged view of an actuator, catch mechanism, and latch in accordance with an embodiment of the present invention.

The present invention is directed to a lighter having an improved resistance to inadvertent or unintended operation. As shown in FIG. 2, the lighter 8 includes a housing 18 or body portion that holds a fuel supply 28, a valve 30 associated with fuel supply 28 to selectively release fuel therefrom, a selectively depressible actuator 10 to operate the lighter, an ignition mechanism 32 for igniting the fuel, a latch member 16 to render the lighter more difficult to inadvertently or unintentionally operate, an optional catch mechanism 22 (not shown) to temporarily hold the latch member 16, and an optional release mechanism 14 to release the latch member from the catch mechanism 22.

The ignition mechanism 32 of the lighter 8 preferably includes a piezoelectric ignition mechanism, although the present invention is not limited to a particular type of ignition mechanism. One suitable piezoelectric mechanism for the lighter 8 is disclosed in U.S. Pat, No. 5,262,697, entitled "Piezoelectric Mechanism for Gas Lighters" which is expressly incorporated by reference herein in its entirety. Another suitable type of ignition mechanism that can be used with the present invention is disclosed in U.S. Pat. No. 5,468,144 to Iwahori. Other ignitors may include those disclosed and described in U.S. Pat. Nos. 5,228,849 and 6,022,211. Because ignition mechanisms and related components for lighters are well-known in the art, one of ordinary skill in the art would readily appreciate how to select suitable materials for the various components for a lighter ignition system.

The fuel supply 28 of the lighter 8 is preferably controlled by a valve 30 that allows a user to selectively release fuel from the fuel supply 28. Preferably, the valve 30 is controlled by actuating the actuator 10. FIGS. 3, 4*a-b*, 5*a-b*, 6*a-b*, and 7*a-b* illustrate an enlarged view of one or more of actuator 10, latch member 16, catch mechanism 22 and release mechanism 14 of one embodiment of the present invention. Preferably, the ignition mechanism 32 and valve 30 are configured and adapted so that a user presses actuating pad 34 of the actuator 10 to both release and ignite fuel gas. In operation, when actuator 10 is depressed it moves the top portion of the ignition mechanism 32 and contacts a valve controller 11 to move valve 30 to release fuel. Alternatively, a portion of the ignition mechanism may contact and move controller 11 to release fuel.

In the embodiment illustrated in FIGS. 2, 3 and 4*a*-4*b*, the actuator 10 is formed with a downwardly extending skirt 36 that fits inside the lighter housing 18. The latch member 16 preferably is formed as a longitudinally downwardly projecting tongue that is integrally connected with the actuator 10. It is preferred that the latch member 16 is formed integrally with the actuator 10 to form a bending connection 38. Alternatively, the latch member can be formed separately from the actuator and may be connected to the actuator by almost any type of connection, such as, for example, a pivoting connection.

Figure 4B:
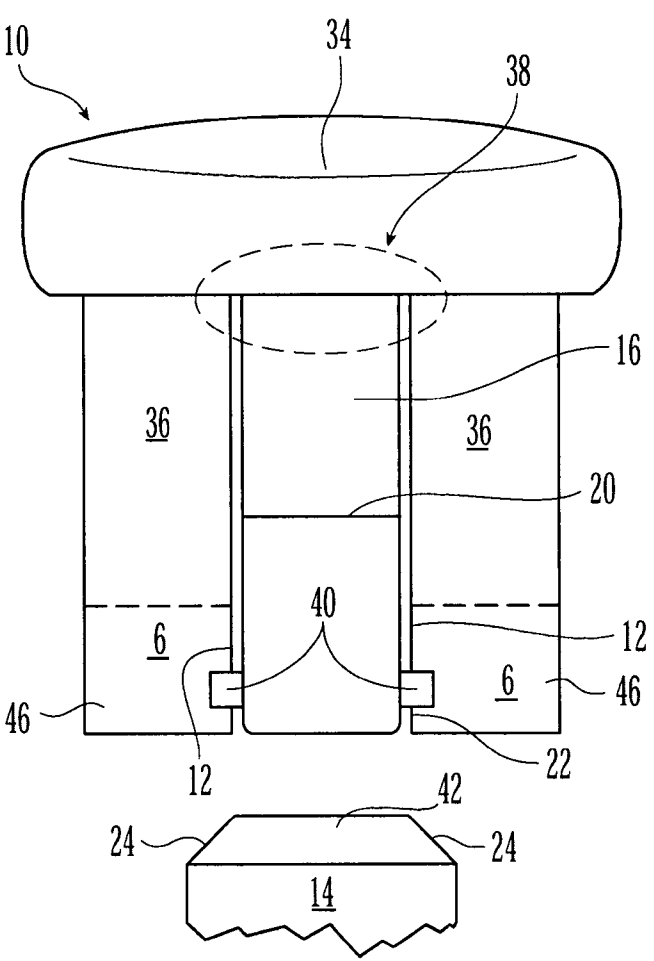
FIG. 4*b* is an enlarged partial side view of the lighter of FIG. 4*a;*
Figure 4A:
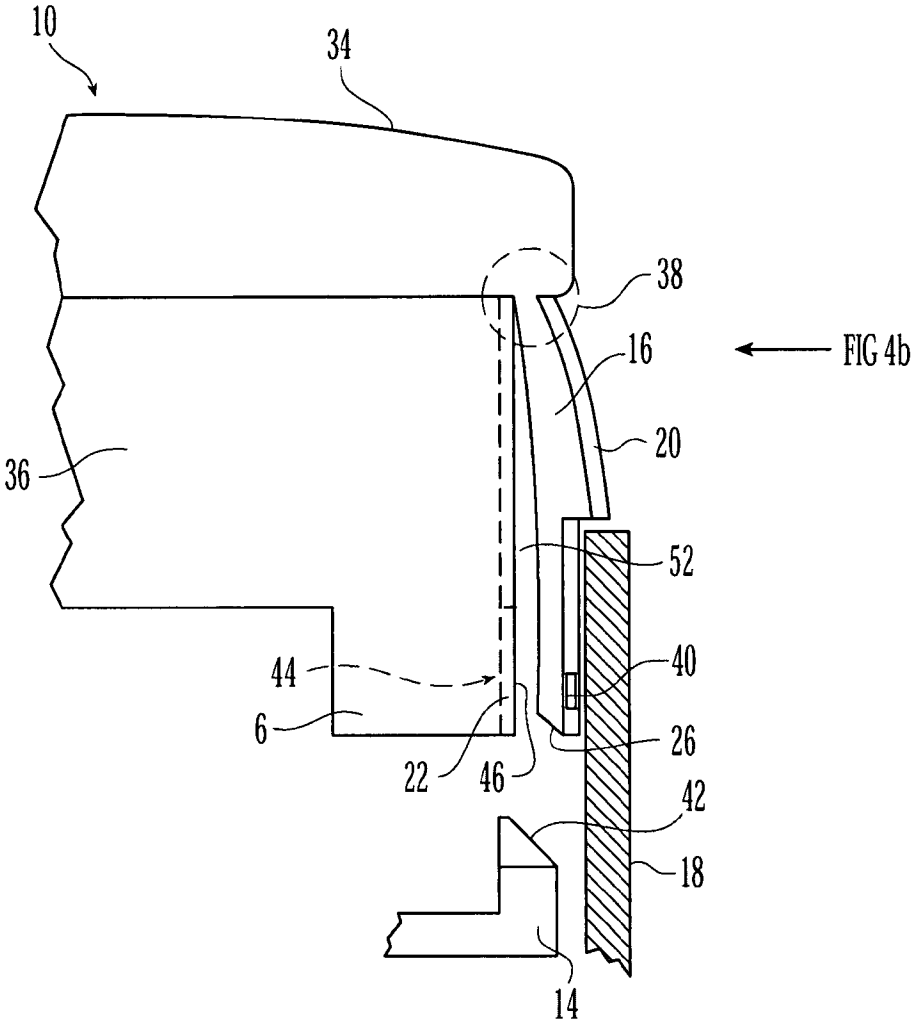
FIG. 4*a* is an enlarged partial cross-sectional view of a lighter made in accordance with an embodiment of the present invention with a latch member in a blocking position.

Preferably, the latch member 16 is sized and configured to further include a stop 20 which blocks activation of the actuator 10 when the latch member 16 is in an interfering relationship with the lighter housing. The stop 20 may be formed as a bump or step-profile on the outer surface of the latch member 16 located above the lighter housing 18 so that downward movement of the actuator 10 is blocked by stop 20 abutting against and interfering with lighter housing 18. As one of ordinary skill in the art would appreciate, many variations of a stop 20 are possible without departing from the spirit and scope of the present invention. For instance, the latch member 16 may be configured with a cavity that corresponds to a tab or step formed on the inside surface of the housing 18. FIGS. 2 and 4*a-b* illustrate the latch and lighter housing when the latch is in its initial state where the latch blocks movement of the actuator 10. The latch 16 may be pre-loaded when it is assembled into the lighter housing such that the resiliency of the latch biases it toward the interfering initial position shown in FIGS. 2 and 4*a*-4*b*.

Figure 5B:
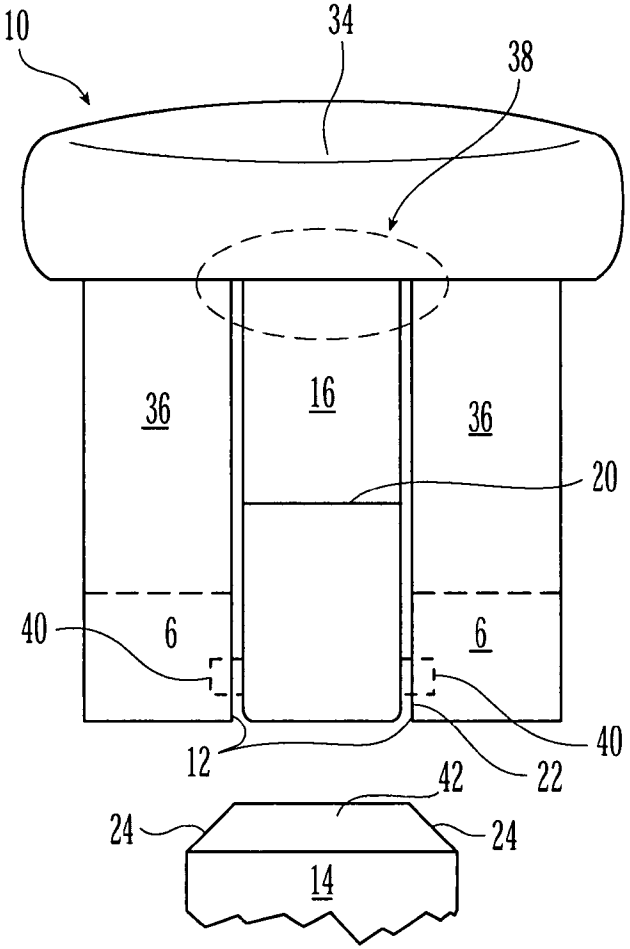
FIG. 5*b* is an enlarged partial side view of the lighter of FIG. 5*a;*
Figure 5A:
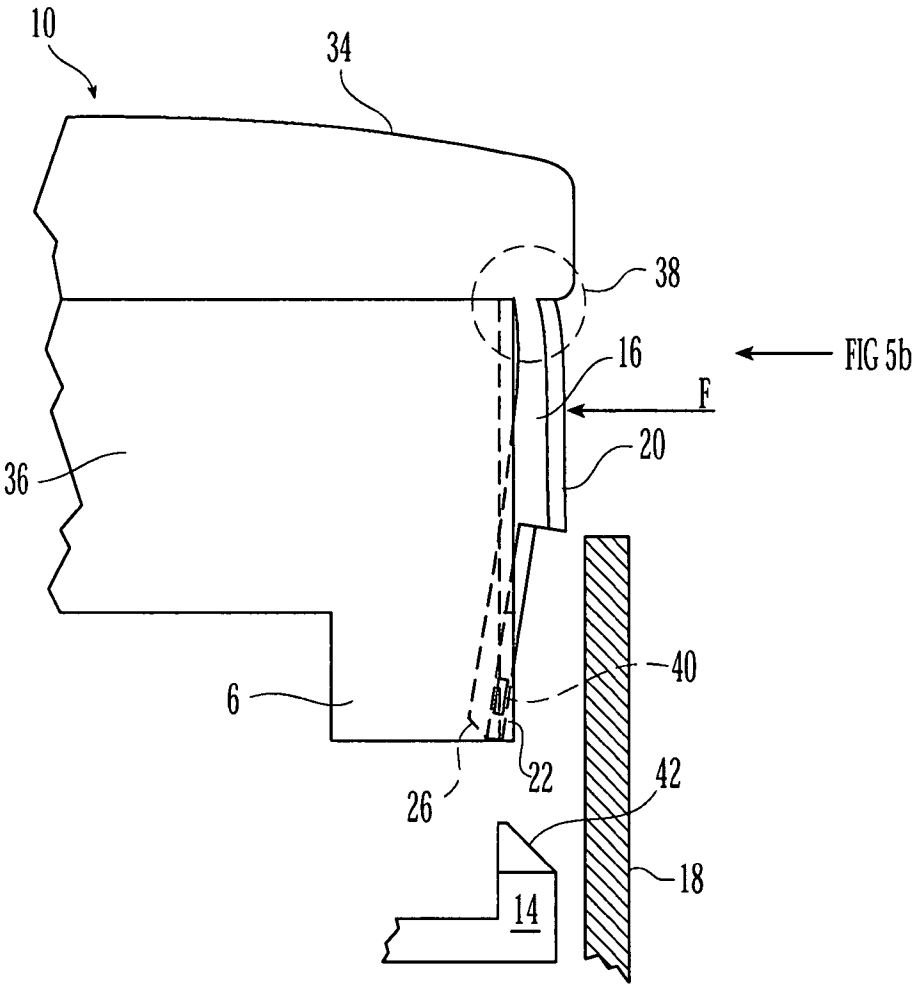
FIG. 5*a* is an enlarged partial cross-sectional view of the lighter of FIGS. 4*a*-4*b* wherein the latch member is in a ready position.

The lighter 8 preferably includes a catch mechanism 22 which engages with and holds the latch member 16 in a ready position where it does not significantly interfere with movement of the actuator 10. As shown in FIGS. 4*a-b* and 5*a-b*, the actuator 10 may be formed with a downwardly extending skirt 36, portions of which may form catch mechanism 22. In a preferred embodiment, the catch mechanism 22 is formed from at least one downwardly extending tongue 6, preferably two tongues 6, in proximity to the latch member 16 so that when the latch member 16 is moved by a user from a blocking position to a ready position (i.e., the latch member 16 is no longer positioned to block movement of the actuator 10) the catch mechanism 22 engages with and holds the latch member 16 in the ready position as shown in FIGS. 5*a*-5*b*.

In the embodiment shown in FIGS. 4-7, at least one flexible tab shaped member(s) 40 extends outwardly from the side edge of the latch member 16, as shown, for example, in FIGS. 4*b* and 5*b*, so that when the latch member 16 is pressed by a user, the tabs 40 contact the edge 12 of skirt 36 that forms catch mechanism 22. Application of sufficient force upon the latch member 16 by the user will flex the catch mechanism 22 and/or tabs 40 until the tabs 40 pass from the outside surface 46 of the skirt 36 to the inside surface 44. (See FIGS. 4*a*-5*b*). While the tabs 40 and/or skirt 36 are sufficiently flexible to permit a user to push the latch member 16 and tabs 40 through the skirt 36, the tabs 40 and skirt 36 are preferably sufficiently stiff to counter any force, for example from the latch member 16 or other components or mechanisms, so that the tabs 40 are held in position behind the skirt 36 upon release of the latch member 16 by the user. Once the latch member 16 is securely held in position by the catch mechanism 22 as illustrated in FIGS. 5*a-b*, the lighter is in the ready position where the latch no longer interferes with the housing and the user may then operate the lighter 8 by pressing down the actuator 10. One skilled in the art would appreciate that the latch member 16 and catch mechanism 22 may be sized and configured in many ways so that the catch mechanism 22 engages with and holds the latch member 16 in the ready position. For example, flexible tabs may extend from the edge 12 of the side skirts 36 to hold the latch member 16 in place.

Figure 6B:
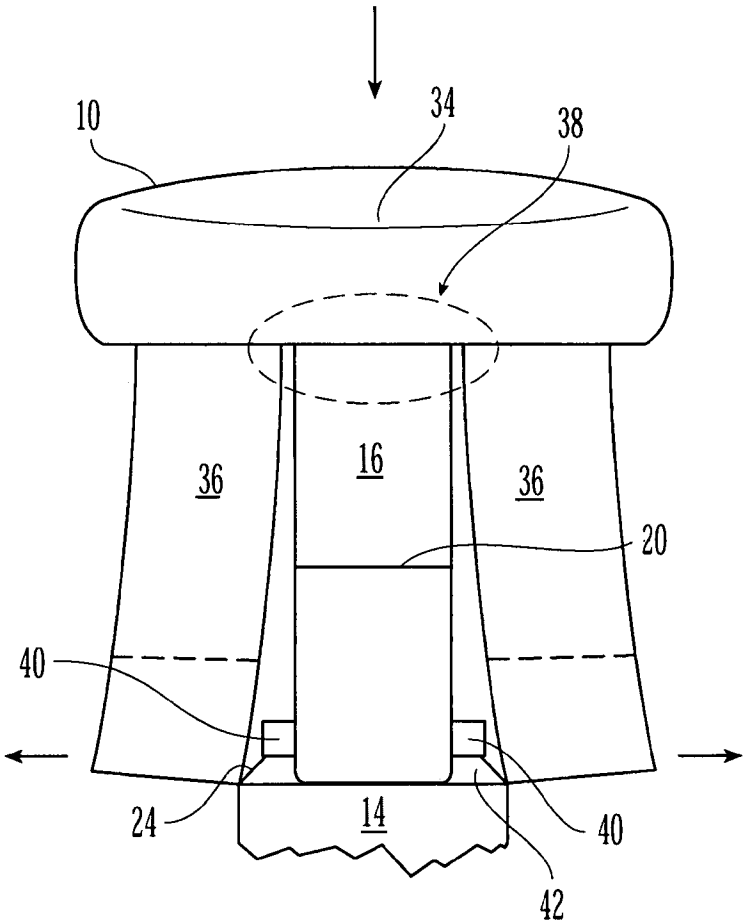
FIG. 6*b* is a partial side view of the lighter of FIG. 6*a;*
Figure 6A:
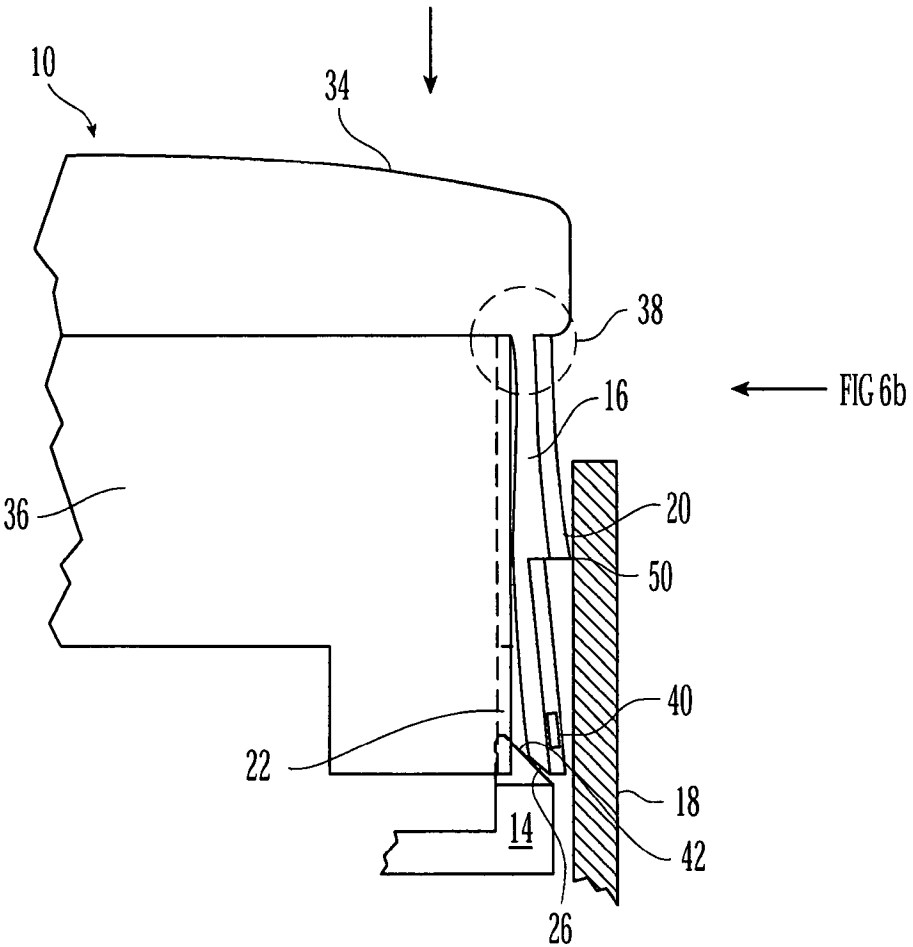
FIG. 6*a* is an enlarged partial cross-sectional view of the lighter of FIGS. 4*a*-4*b* with the latch member in an actuated position.

The lighter 8 also preferably includes a release mechanism 14 which causes the latch member 16 to disengage from the catch mechanism 22. The release mechanism 14 may comprise a cam to dislodge the latch member 16 from the catch mechanism. As shown in FIGS. 6*a* and 6*b* for example, the catch mechanism 22 and latch member 16 are brought into contact with cam as the user depresses the actuator 10 so that the cam separates or dislodges the latch member 16 from the catch mechanism 22. As shown in FIGS. 4*a*, 5*a*, 6*a*, and 7*a*, the cam preferably has an angled surface 42. The angled surface and position of cam may be configured to apply sufficient force to release the latch member 16 from the catch mechanism 22 when the user presses the actuator 10 to operate the lighter 8. Alternatively or in addition to, the cam also may have angled side surfaces 24 as illustrated in FIGS. 5*b* and 6*b* which cause the side skirts 36 to spread apart and release latch member 16. As the cam surface 24 spreads side skirts 36 apart, cam surface 24 may move the lower end of the latch so that the tabs are positioned on the outside surface 46 of the side skirts 36.

Figure 9:
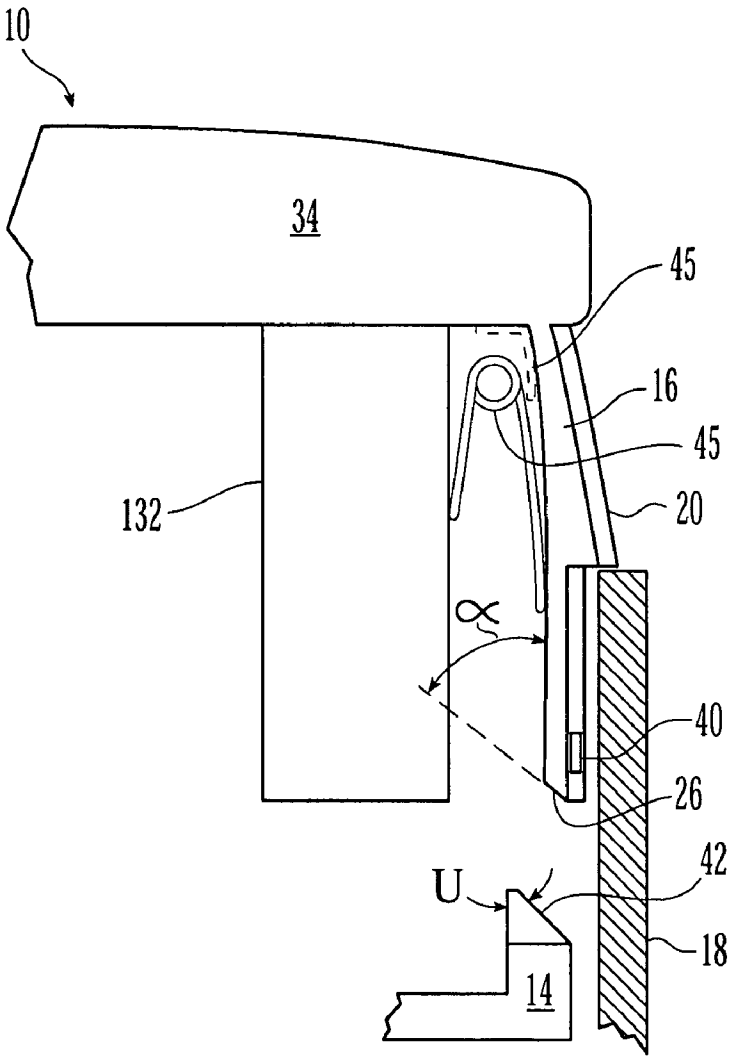
FIG. 9 is an enlarged partial cross-sectional view of a lighter in accordance with another embodiment of the present invention with a spring biasing the latch member toward a blocking position.

The cam is sized and positioned so that the forces it imparts on the latch member 16 and catch mechanism 22 are sufficient to disengage the tabs 40 from the inside surface 44 of the catch mechanism 22. As stated above and shown in FIGS. 6*a*-6*b*, the lower surface 26 of the latch member 16 may be sized and configured to assist in releasing the latch member 16 from the catch mechanism 22 as the latch member 16 travels across the cam. Preferably, the surfaces 26 and 42 of the latch member 16 and cam that contact each other are configured and adapted to permit sliding with respect to each other. For example, as shown in FIG. 9, the latch lower surface 26 may have an angle αapproximately corresponding to, and preferably the same as, the angle u of the cam surface 42 that it contacts when the user presses the actuator 10.

In addition, components other than cam may be utilized as the release mechanism, such as, for example, portions of the ignition mechanism or housing. The latch can have an inclined lower surface 26 shaped to assist in releasing it from the catch mechanism. One skilled in the art would appreciate that the release mechanism 14 may be sized, shaped and configured to apply different forces or combinations of forces to the latch member 16 and the catch mechanism 22. For example, the release mechanism 14 may apply a force on one component before the other or the release mechanism 14 may only impart a force on the latch member 16 but not the catch mechanism 22 or vice versa. Further, one skilled in the art would appreciate that the forces imparted on the catch mechanism 22 and latch member 16 by the release mechanism 14 can occur at different locations than those illustrated or can occur simultaneously or at different times, again depending on the size, shape and configuration of the release mechanism 14, latch member 16 (including the tabs 40), and catch mechanism 22. In addition, while the release mechanism of FIGS. 4, 5, 6 and 7 remains stationary with respect to the lighter housing 18 during operation of the lighter 8, one skilled in the art can appreciate that the release mechanism may move with respect to the latch and lighter housing.

One skilled in the art would appreciate that connection 38 need not impart a biasing force to return the latch to the initial blocking position. However, the latch may be pre-loaded when assembled in the lighter such that it is bent at connection 38 so that it is biased towards a position which blocks or interferes with movement of the actuator as shown in FIGS. 4*a-b*.

It is preferred that the lighter contain additional or alternative forces on the latch member to improve the ability of the latch member to return to the blocking position over the life of the lighter. In some of the embodiments of the present invention, this additional or alternative biasing force is provided by an additional flexure or bending moment imparted to the latch member. For example, a force or forces may be applied to the latch member so that the entire latch member or at least a portion of the latch member flexes or is imparted with a bending moment. The flexure or bending moment imparted to the latch member 16 to flex the latch member may be provided, for example, by configuring the release mechanism and/or catch mechanism to apply appropriate forces to the latch member 16 to improve the ability of the latch member to return to the blocking position over the life of the lighter.

Figure 7B:
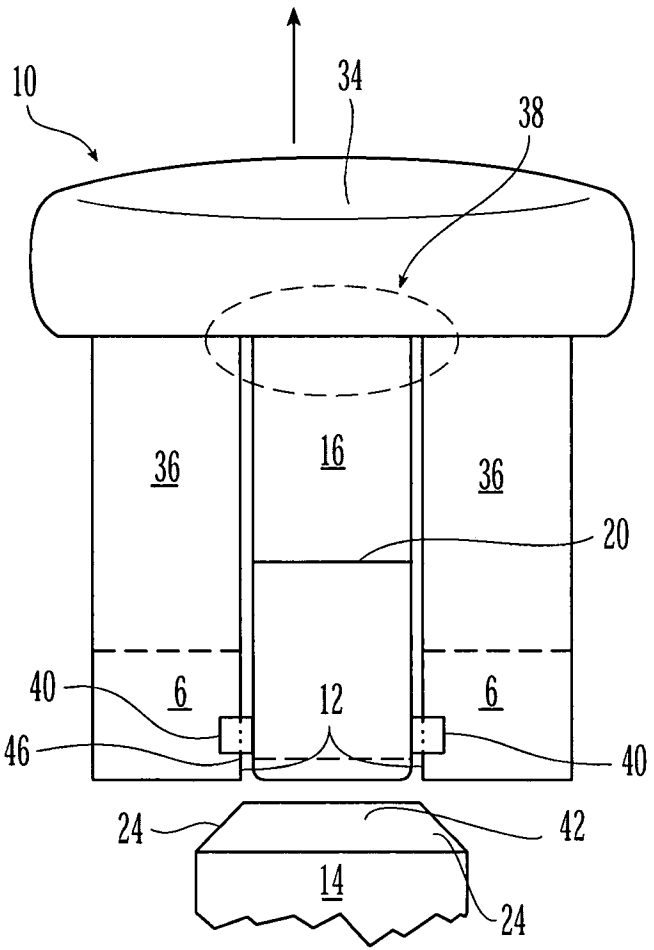
FIG. 7*b* is a partial side view of the lighter of FIG. 7*a;*
Figure 7A:
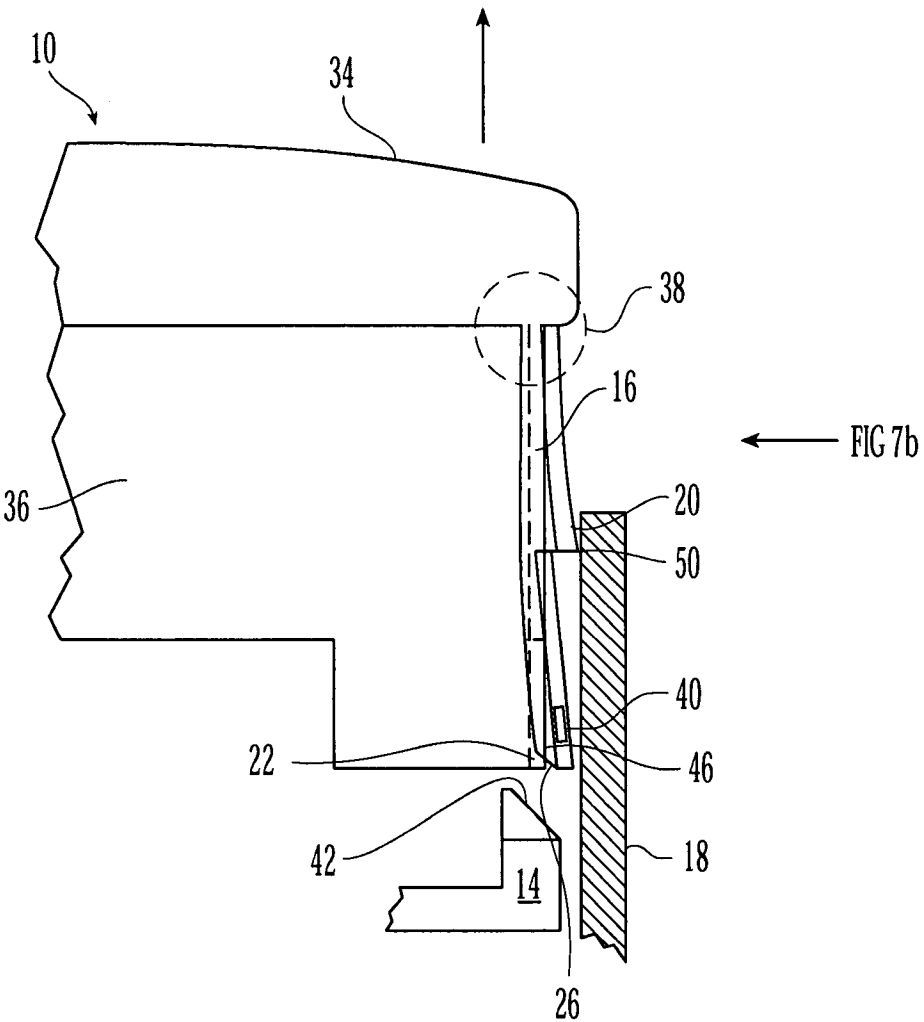
FIG. 7*a* is an enlarged partial cross-sectional view of the lighter of FIGS. 4*a*-4*b* with the latch member as it travels upwardly back toward its initial blocking position.

When the actuator is depressed as shown in FIGS. 6*a*-6*b*, the cam or release mechanism 14 imparts a force to the lower surface 26 of the latch member 16 to flex the bottom portion of the latch member 16 outwardly as the cam spreads apart the side skirts 36 to release the tabs 40. As the actuator 10 travels upward toward its initial position as shown in FIGS. 7*a*-7*b*, the release mechanism 14, is disengaged from the latch member 16 and side skirts 36. As the cam 14 disengages from the side skirts 36, the gap between the side skirts and latch member 16 closes. As the side skirts close, the tabs 40 of latch member 16 are on the outside surface 46 of the catch mechanism as the cam surface 42 disengages from the lower end 26 of the latch so that the tabs 40 contact and press against the outer surface 46 of the catch mechanism 22 as the latch member 16 travels back up towards its initial position. The pressing of the tabs 40 against the catch mechanism 22 keeps the bending or flexing force on the bottom portion of the latch member 16 to flex or bend the latch. The latch flexes or bends until the latch member 16 returns to its blocking position.

The latch member and the catch mechanism preferably are configured so that the latch member does not re-engage with the catch mechanism without assistance from a user as a result of the forces applied to the tabs on the latch by the outside surface of the catch mechanism in order to flex the latch. In other words, the latch member 16 preferably is configured and adapted so that the forces imparted by its flexing do not cause the latch member 16 to re-engage with the catch mechanism 22 without assistance from the user.

In this embodiment, the stop 20 may act as a fulcrum 50 which contacts the housing and counter acts the force imparted on the tabs 40 of the latch by the catch mechanism 22. One skilled in the art would appreciate, however, that portions of the latch member other than the stop 20 may contact the housing or similar structure to provide a counteracting force until the latch is free to move into a blocking position. For instance, the upper edge of the housing 18 could act as a fulcrum and apply a counteracting force against the latch member 16 until the stop 20 is moved above the housing. In any embodiment using a fulcrum, the fulcrum may be positioned at any location along the length of the latch member 16 although it is preferred that the fulcrum be positioned between the connection 38 and the force imparted to the latch member 16 to flex the latch member.

As the actuator 10 returns to its initial position, the latch moves upwards in its flexed state until the stop is free to return to its blocking position. Once the stop is above the housing, the forces imparted by the catch mechanism are no longer counterbalanced and the latch moves into its blocking position, where it may or may not further contact the catch mechanism. In the embodiment shown in FIGS. 4, 5, 6 and 7 the clearance or gap 52 between the tabs 40 and the catch mechanism 22 (the tongues 6) when the latch is in the initial position of FIGS. 4*a-b* may be on the order of 0.1-0.2 mm, although these values are only exemplary and should not be limiting.

While FIG. 7*a-b* illustrates latch member 16 flexing along its entire length, the latch member and components of the lighter may be sized, shaped and configured to flex the latch member only along a portion of its length or to flex the latch member 16 in multiple locations along its length. For example, the portion between mechanical stop 20 and latch lower surface 26 or between the mechanical stop 20 and connection 38 or other locations and portions may be adapted and configured to flex.

Alternatively, other parts of the lighter besides the catch mechanism may be used to apply a bending or flexing force on the latch. The bending or flexing force may be applied to the latch as it is released or forced from the catch mechanism, or applied to the latch during its travel up towards its blocking position. For instance, the release mechanism 14 may be configured and adapted so that it continues to apply an outwardly force on the lower surface 26 of the latch member 16 from when it is released from the catch mechanism until the actuator 10 returns to its initial position. One skilled in the art could envision many variations of the size and configuration of the latch member 16, tabs 40, side skirts 36, cam and various other structures to impart a force to the latch to flex or bend the latch without departing from the spirit and scope of the present invention.

Figure 8C:
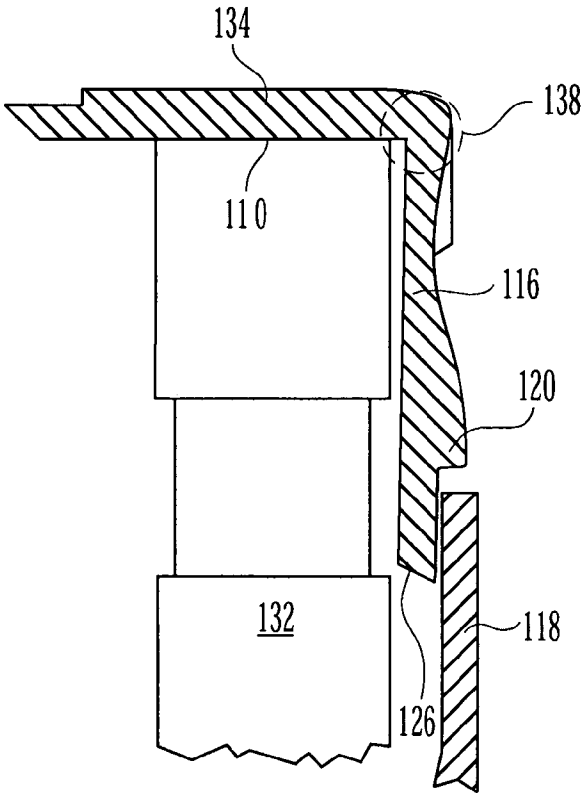
FIG. 8*c* is an enlarged partial cross-sectional view of the lighter of FIG. 8*a* wherein the activator and latch have returned to the initial blocking position.
Figure 8B:
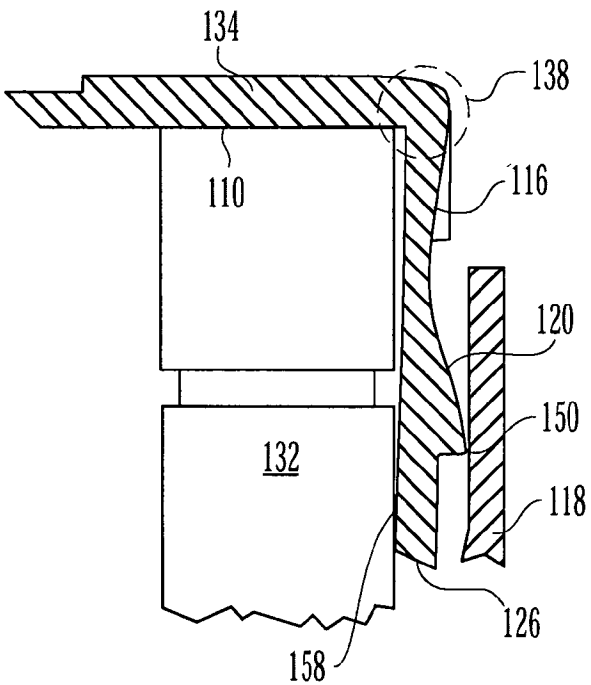
FIG. 8*b* is an enlarged partial cross-sectional view of the lighter of FIG. 8*a* wherein the actuator has been activated to ignite the lighter.
Figure 8A:
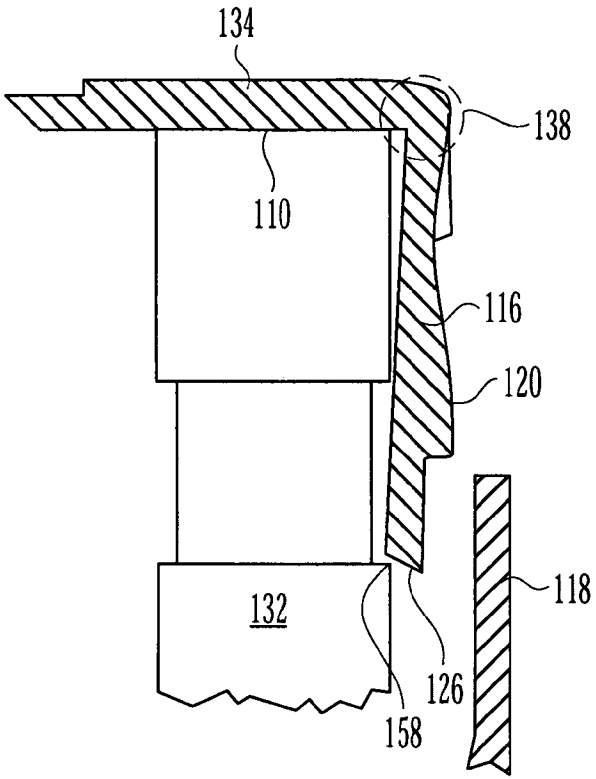
FIG. 8*a* is an enlarged partial cross-sectional view of a lighter having an actuator and a latch member formed in accordance with another embodiment of the present invention wherein the latch is in a ready position.

For example, in the embodiment shown in FIG. 8*a*, the latch member is moved into a ready position and held in position by a catch mechanism which is not shown. When the user depresses actuator 10 as illustrated in FIG. 8*b*, the lower portion 126 of latch 116 contacts portion 158 of the piezoelectric ignition mechanism 132 and dislodges the latch 116 from its ready position by applying an outwardly force on lower surface 126 to move tabs 140 (not shown) out of the catch mechanism (not shown). Once the latch member is dislodged from its ready position, the piezoelectric ignition mechanism continues to apply a force on the latch 116 to move it in an outwardly direction until the actuator has almost returned fully to its non-activated or initial position.

The forces applied to the latch member 116 by the piezoelectric ignition mechanism are counteracted by the stop member 120 acting as a fulcrum 150 as it is pushed against lighter housing 118. The latch member 116 flexes or bends which encourages the latch member to return to the blocking position after the user has completed using the lighter. As the actuator and latch member travel upwardly, the stop member 120 eventually passes above the lighter housing 118 and the latch member 116 is moved to its initial position (FIG. 8*c*) by the forces imparted on the latch by the piezoelectric ignition mechanism. Stated differently, the flexing of the latch member creates a reactive force to return the latch member to the locked position after the actuator returns to its initial, at rest, position.

As would be appreciated by one skilled in the art, the forces applied to the latch member 116 may be applied at any location along the latch member, such as, for example, at a location below the stop member 20, as shown in FIG. 8*b*. It is preferred, however, that the forces are applied at a location near the lower end 126 of the latch. Furthermore, other lighter components or additional structure also may be configured and adapted to flex the latch member to the blocking position instead of the piezoelectric ignition mechanism.

Additional biasing forces to return latch member 16 to its initial blocking position may also be provided by a spring 45, as shown in FIG. 9. As would be readily appreciated by one skilled in the art, the spring 45 may be configured and adapted to provide a force sufficient to bias the latch member 16 toward its blocking position while not imparting enough force to prematurely disengage the latch member 16 from the catch mechanism 22. Examples of spring types that may be used include a leaf spring, torsion spring or a helical spring, although no particular type of spring is preferred over another. The spring 45 also may work in combination with additional structures to bias the latch member 16 toward its blocking position, such as in any of the embodiments described herein. For instance, the spring 45 may be used in combination with the cam or catch mechanism 22 applying a force on the latch member as described in the embodiments above.

The interaction between the release mechanism 14, catch mechanism 22 and latch member 16 to free the latch member 16 from the catch mechanism 22 may be accomplished in a number of ways without departing from the spirit and scope of the invention. For example, the release mechanism 14 may be configured and adapted to apply a releasing force on the latch member 16 at all times, even when the latch member 16 is in a blocking position and the lighter 8 is not in use. In this embodiment, the release mechanism 14 may be configured and adapted so that the forces imparted to the latch member 16 are insufficient to prematurely release the latch member 16 from the catch mechanism 22 but can increase as the actuator 10 is pressed by a user.

Figure 10B:
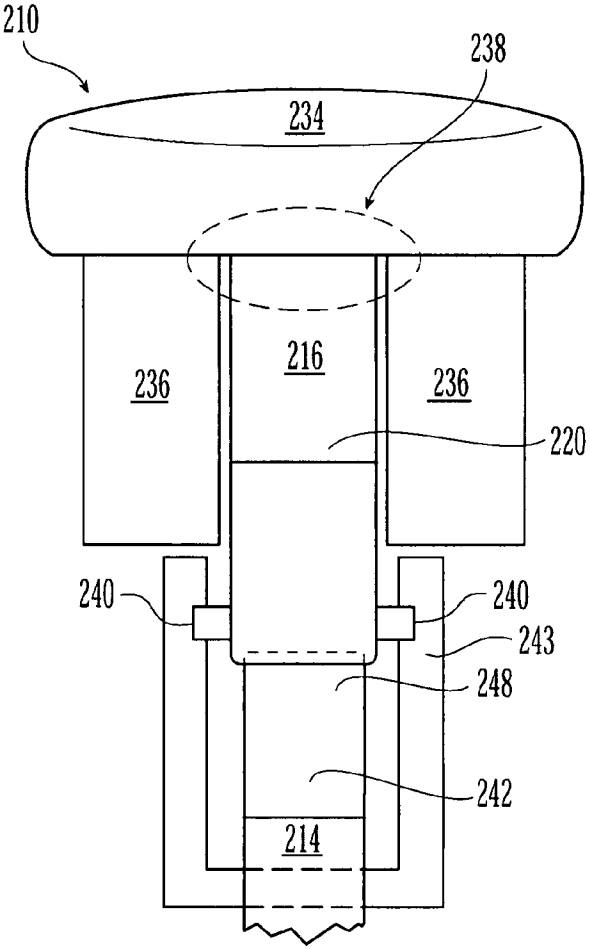
FIG. 10*b* is an enlarged partial side view of the actuator, latch member, and cam assembly of FIG. 10*a;*
Figure 10A:
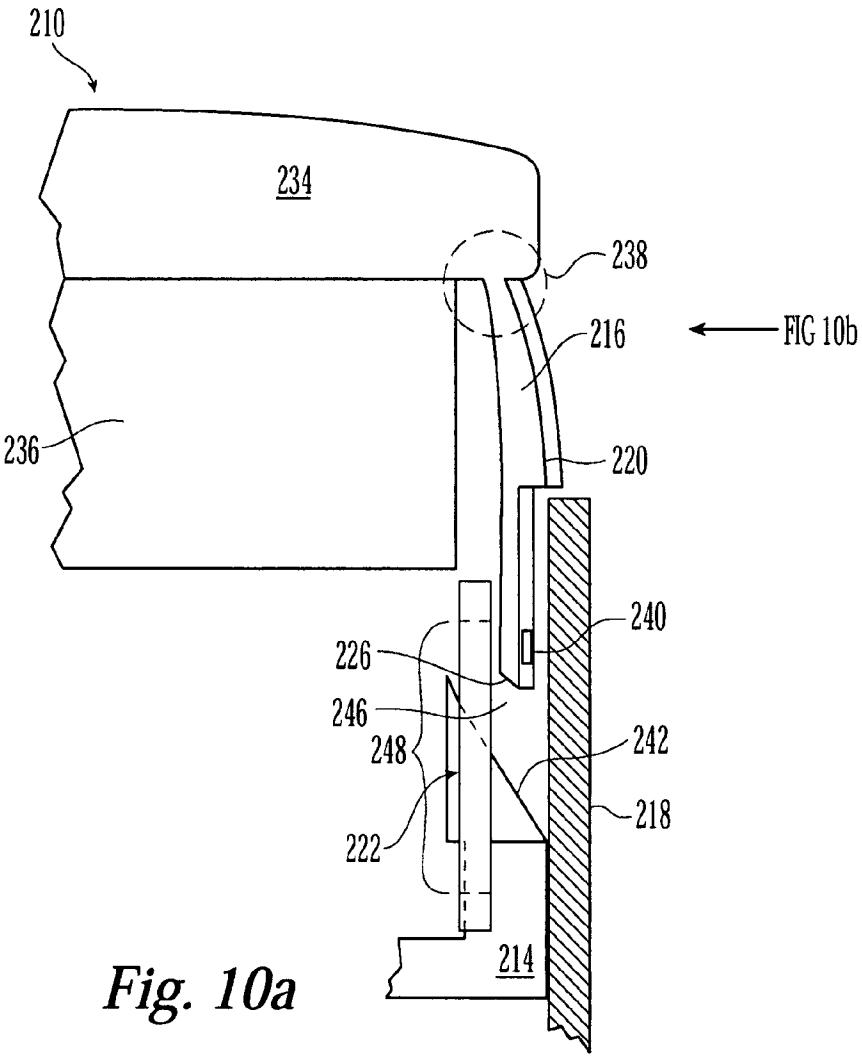
FIG. 10*a* is an enlarged partial cross-sectional view of another embodiment of a lighter in accordance with the present invention with a catch mechanism stationary with respect to the housing.
Figure 10D:
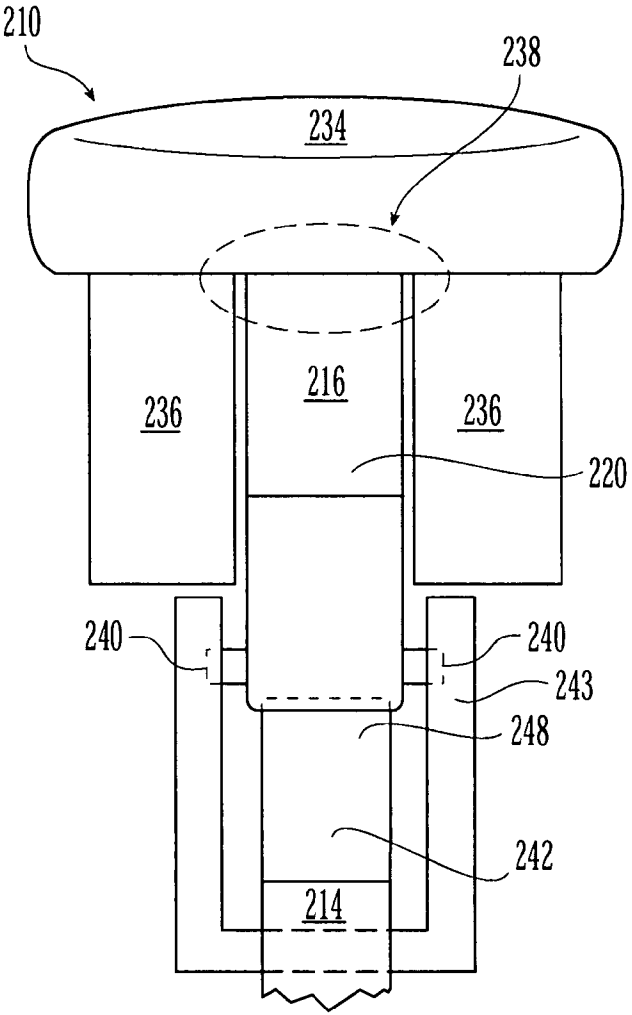
FIG. 10*d* is an enlarged partial side view of FIG. 10*c;*
Figure 10C:
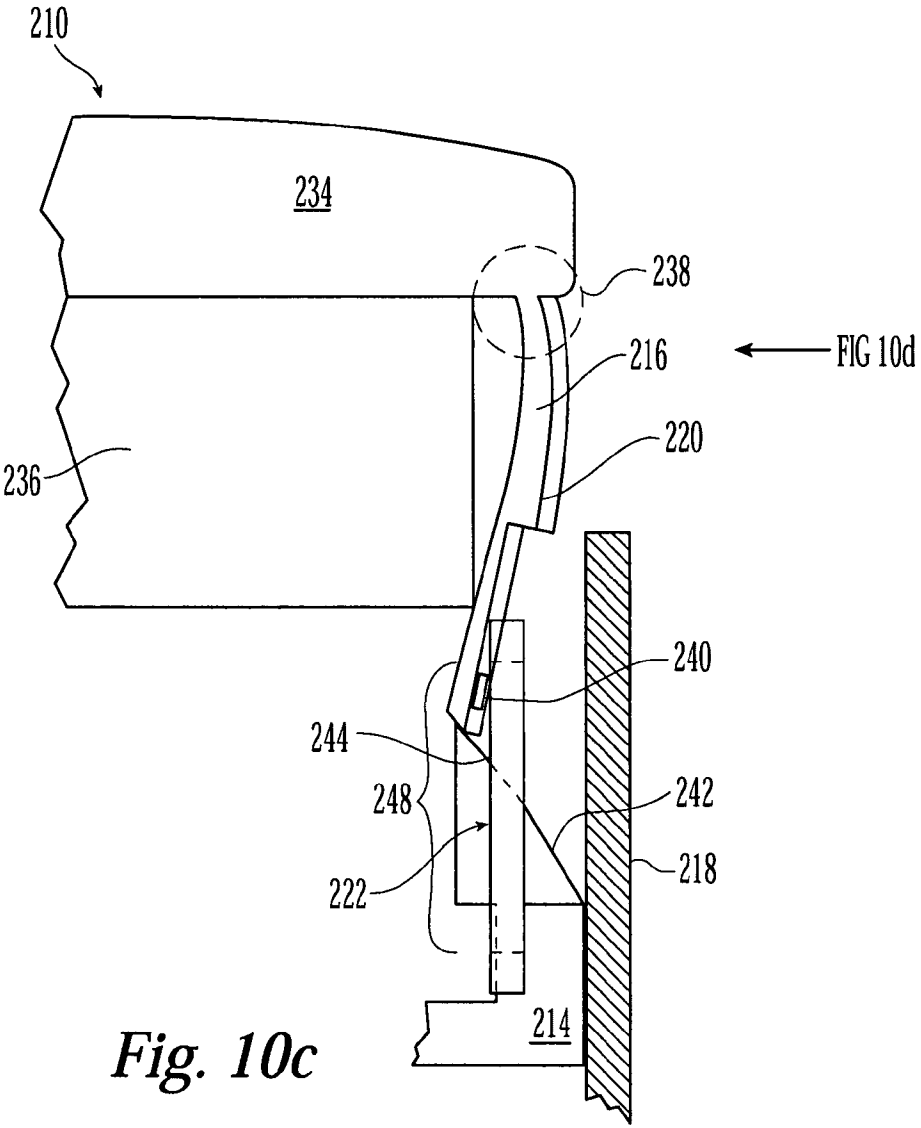
FIG. 10*c* is an enlarged partial cross-sectional view of the lighter of FIG. 10*a* with the latch in a ready position.
Figure 10F:
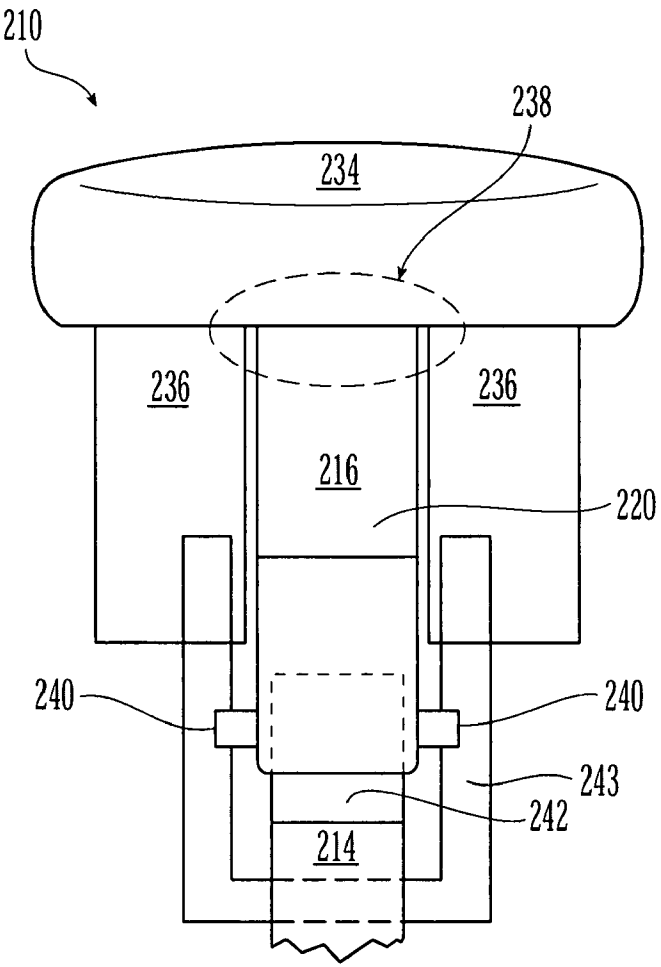
FIG. 10*f* is an enlarged partial side view of FIG. 10*e;*
Figure 10E:
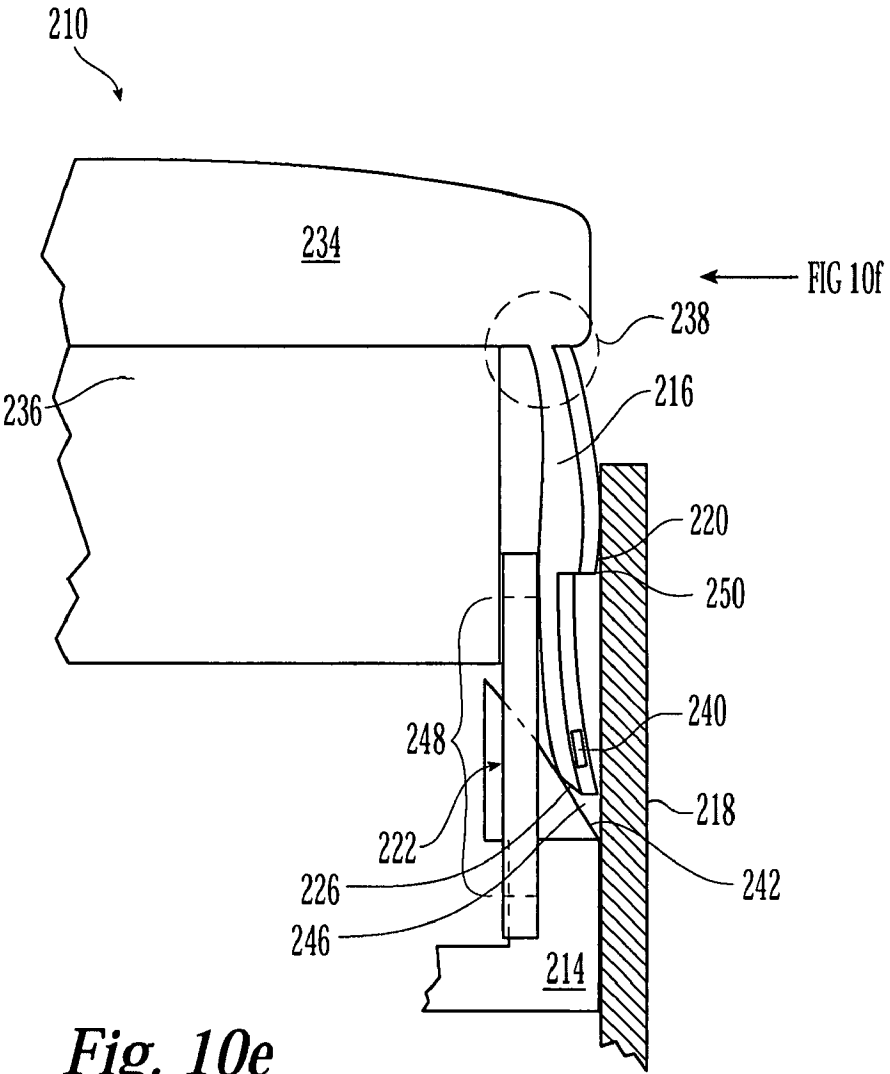
FIG. 10*e* is an enlarged partial cross-sectional view of the lighter of FIG. 10*a* with the actuator depressed.

In yet another embodiment, illustrated in FIGS. 10*a*-10*h*, the catch mechanism 222 remains stationary relative to the lighter housing 218. In FIGS. 10*a-b* the latch 216 is shown in its initial blocking position where stop 220 interferes with housing 218 and tabs 240 are on the outside surface 246 of the catch mechanism 222. In this embodiment the catch mechanism 222 has an elongated slot 248 through which the latch member 216 is inserted when pressed inwardly by a user. As shown in FIG. 10*c-d*, the latch member 216, and more particularly tabs 240, engage the catch mechanism 222, and more specifically tab holding members 243, at the top end of the slot 248 so that the latch member 216 is held in a ready position. As the user presses the actuator 210, the latch member 216 travels along the inside surface of the catch mechanism 222 until the latch member 216 contacts the release mechanism 214 as shown in FIGS. 10*e-f*. As the actuator is further pressed by the user, the release mechanism 214 applies a force which releases the latch member 216 from the catch mechanism 222, and flexes the latch.

Figure 10H:
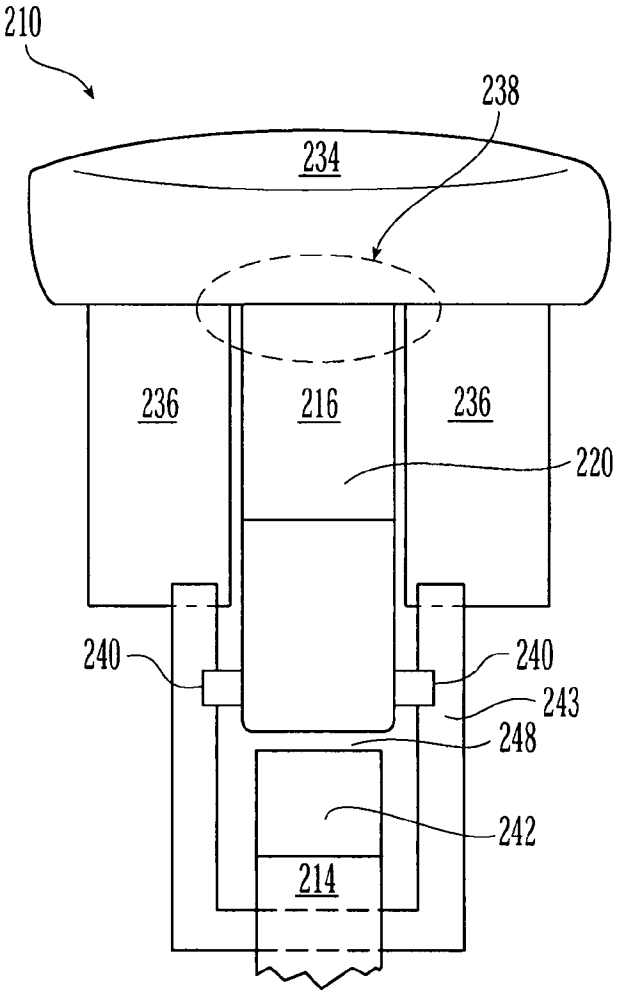
FIG. 10*h* is an enlarged partial side view of FIG. 10*g*.
Figure 10G:
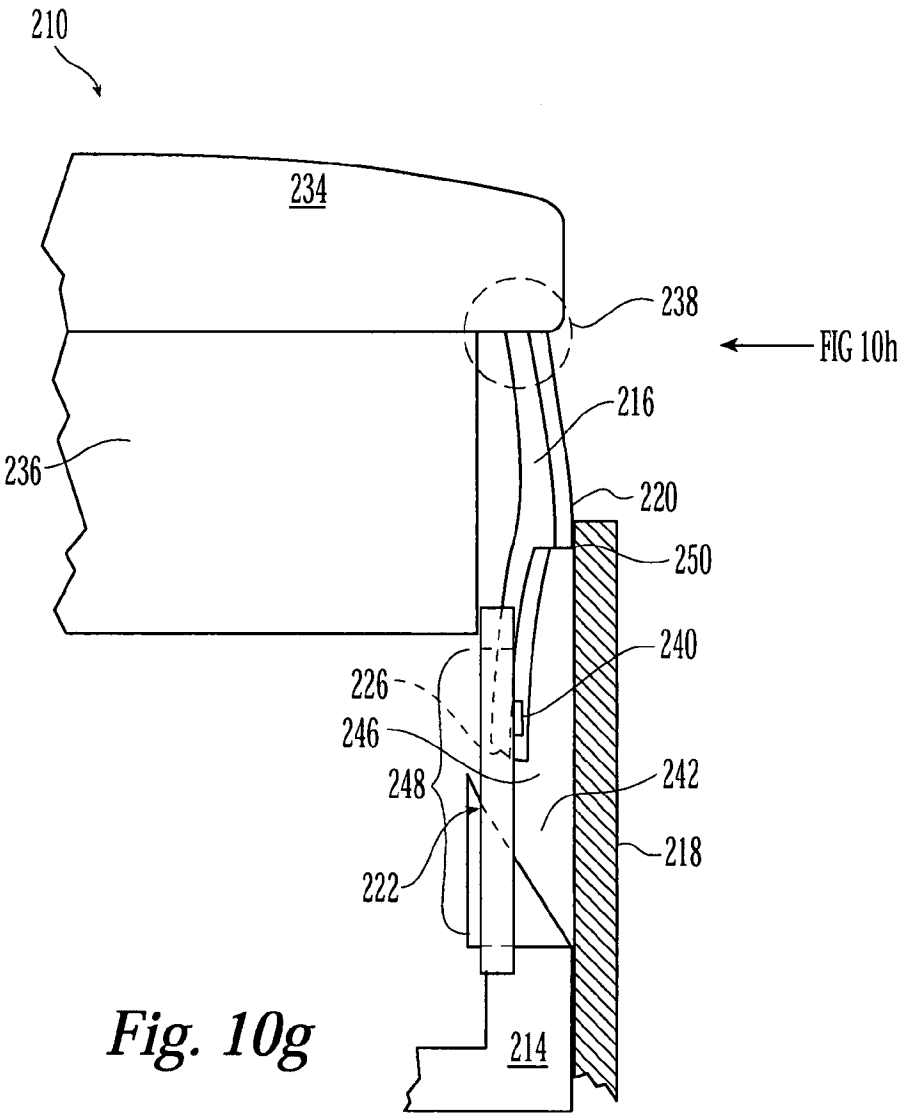
FIG. 10*g* is an enlarged cross-sectional view of the lighter of FIG. 10*a* with the latch member as it travels upwardly back toward its initial position.

As the actuator 210 moves upward toward its initial position, the latch member 216 and more particularly tabs 240 travel along the outer surface 246 of the catch mechanism 222 flexing latch 216 as illustratively shown in FIGS. 10*g-h* until the latch member 216 returns to its blocking position. In this embodiment, the slot 248 of the catch mechanism 222 may be configured and adapted to be more flexible or pliable at the portion of the slot 248 where the latch member 216 engages the slot 248 and/or the portion where the latch member disengages the slot, while having more rigid portions preventing the latch member 16 from re-engaging with the catch mechanism 222 as the latch member 216 is returning to its initial blocking position. As one skilled in the art can appreciate the shape, size, configuration, materials and dimensions of the tabs, latch member and catch mechanism can be designed and adapted so that the force to engage, retain and release the latch member can be tailored to specific design criteria and needs so that the components will interact and release under desirable forces at the desired time and location during motion of the actuator pad.

The present invention is not limited to the structure described above; rather, all reasonable variations are intended to be included within the scope of the claims. For example, one skilled in the art would appreciate that the catch mechanism and latch member may be sized and configured in many ways to hold the latch member in a ready position when desired by a user while also allowing for the latch member to be released from the catch mechanism once the actuator is activated. In addition, other mechanisms other than those shown and described herein can impart a flexure or bending moment to the latch member to assist the latch in returning to its blocking position during the life of the lighter and should be included within the spirit and scope of the invention. Moreover, the embodiments above can be modified so that some features of one embodiment may be used with the features of another embodiment. For instance, a spring may be used in combination with a flexing latch member to further assist returning the latch member to a blocking position after the actuator is released by the user. It is intended that the present invention cover all such modifications and embodiments as falling within its true spirit and scope.

What is claimed is:

1. A lighter comprising:

a housing having a fuel supply;

an ignition mechanism for igniting the fuel;

an actuator for releasing fuel from the fuel supply and operating the ignition mechanism;

a latch member having an upper end, a lower end, and a blocking portion, the latch member being integrally coupled at the upper end to the actuator, the latch member being movable between a blocked position where in an interfering position the blocking portion abuts a portion of the housing blocking downward movement of the actuator and a ready position where the blocking portion does not block movement of the actuator, the latch member being elastic so that the latch member is biased with a first biasing force to return to the blocked position, wherein the lower end has a latch lower surface that is angled;

a biasing component configured and adapted to impart a second biasing force to at least a portion of the latch member so that the latch member is further biased toward the blocked position by the biasing component;

a catch mechanism, comprising one or more side skirts, sized and configured to receive and maintain the latch member when the latch member is moved from the blocked position to the ready position; and a cam attached to the ignition mechanism to release the latch member from the catch mechanism, wherein the cam comprises one or more angled side surfaces configured to engage the one or more side skirts causing the one or more side skirts to flex away from the lower end of the latch member when a user presses the actuator to operate the lighter.

2. The lighter of claim 1, wherein the biasing component is a spring.

3. The lighter of claim 1, wherein the biasing component is an additional bending moment on the latch member.

4. The lighter of claim 1, wherein the latch member is configured and adapted such that a portion of the latch member besides the integral coupling to the actuator flexes to produce the second biasing force.

5. The lighter of claim 1, wherein the latch member and the housing are sized and configured to exert the second biasing force.

6. The lighter of claim 1, further comprising a release mechanism to release the latch member from the catch mechanism, the release mechanism being configured and adapted to impart the second biasing force on the lower end of the latch member in order to flex the latching member.

7. The lighter of claim 1, wherein the second biasing force causes a portion of the latch member to flex.

8. The lighter of claim 1, further comprising a release mechanism to release the latch member from the catch mechanism, the latch member and the release member are sized and configured so that after the latch member is disengaged from the catch mechanism, the latch member rests against an outer surface of the catch mechanism in order to apply the second biasing force to the latch member.

9. The lighter of claim 1, wherein the lighter further includes a cam attached to the ignition mechanism, the cam being configured and adapted to apply the second biasing force on the lower end of the latch member.

10. The lighter of claim 1, wherein the blocking portion is a stop member.

11. The lighter of claim 1, wherein the catch mechanism comprises the at least one side skirt projecting away from the actuator.

12. A lighter comprising:

a housing having a fuel supply;

an ignition mechanism for igniting the fuel;

an actuator for releasing fuel from the fuel supply and operating the ignition mechanism;

a latch member having an upper end, a lower end, and a blocking portion, the latch member being integrally coupled at the upper end to the actuator, the latch member being movable between a blocked position where in an interfering position the blocking portion abuts a portion of the housing blocking downward movement of the actuator and a ready position where the blocking portion does not block movement of the actuator; the latch member being elastic so that the latch member is biased to return to the blocked position, wherein the lower end has a latch lower surface that is angled;

a biasing component configured and adapted to impart a second biasing force to at least a portion of the latch member so that the latch member is further biased toward the blocked position by the biasing component;

a catch mechanism comprising one or more side skirts, having a length, extending longitudinally along the housing from the actuator sized and configured to receive and maintain the latch member when the latch member is moved from the blocked position to the ready position; and a cam attached to the ignition mechanism to release the latch member from the catch mechanism, wherein the cam comprises one or more angled side surfaces configured to engage the one or more side skirts causing the one or more side skirts to flex away from the lower end of the latch member when a user presses the actuator to operate the lighter.

13. The lighter of claim 12, wherein the biasing component is a spring.

14. The lighter of claim 12, wherein the biasing component is an additional bending moment on the latch member.

15. The lighter of claim 12, wherein the latch member is configured and adapted such that a portion of the latch member besides the integral coupling to the actuator flexes to produce the second biasing force.

16. The lighter of claim 12, wherein the latch member and the housing are sized and configured to exert the second biasing force.

17. The lighter of claim 12, wherein the cam imparts the second biasing force on the lower end of the latch member in order to flex the latching member.

18. The lighter of claim 12, wherein the latch member and the cam are sized and configured so that after the latch member is disengaged from the catch mechanism, the latch member rests against an outer surface of the catch mechanism in order to apply the second biasing force to the latch member.

19. The lighter of claim 12, wherein the cam is configured and adapted to apply the second biasing force on the lower end of the latch member.

20. The lighter of claim 12, wherein the blocking portion is a stop member that resists movement of the actuator when the latch member is in the blocked position.

* * * * *